US006088009A

United States Patent [19]

Moon

[11] Patent Number: 6,088,009

[45] Date of Patent: Jul. 11, 2000

[54] DEVICE FOR AND METHOD OF COMPENSATING IMAGE DISTORTION OF PLASMA DISPLAY PANEL

[75] Inventor: Seong Hak Moon, Kyungki-do, Rep. of Korea

[73] Assignee: LG Electronics Inc., Seoul, Rep. of Korea

[21] Appl. No.: 08/863,295

[22] Filed: May 27, 1997

[30] Foreign Application Priority Data

May 30, 1996 [KR] Rep. of Korea ..... 96-18665

[51] Int. Cl.[7] ..... G09G 3/28

[52] U.S. Cl. ..... 345/60; 345/63; 345/67; 315/169.4

[58] Field of Search ..... 345/37, 60, 67, 345/68, 62, 63, 72, 212, 204; 315/169.1, 169.4; 313/581, 585

[56] References Cited

U.S. PATENT DOCUMENTS

| | | | |
|---|---|---|---|
| 5,420,602 | 5/1995 | Kanazawa | 345/67 |
| 5,436,634 | 7/1995 | Kanazawa . | |
| 5,446,344 | 8/1995 | Kanazawa . | |
| 5,471,228 | 11/1995 | Ilcisin et al. | 345/58 |
| 5,583,527 | 12/1996 | Fujisaki et al. | 345/55 |
| 5,874,932 | 2/1999 | Nagaoka et al. | 345/60 |
| 5,889,501 | 3/1999 | Sasaki et al. | 345/60 |

FOREIGN PATENT DOCUMENTS 4-195188 7/1992 Japan .

*Primary Examiner*—Dennis-Doon Chow
*Assistant Examiner*—Amr Awad

[57] ABSTRACT

A device for compensating for image distortion of a plasma display panel using a subfield driving method includes: a control unit for generating the number of first and second sustain pulses that is proportional to the relative ratio of luminance of each subfield, and control signals, and an image distortion compensation unit for adding one or more first and second pseudo pulses in each interval of the first and second sustain pulses corresponding to at least any one of subfields, according to the control signals, and generating first and second compensation pulses to compensate for the image distortion. This enhances the quality of images even when adjacent gray scale signals are supplied in succession. By adding pseudo pulses in each interval of the sustain pulses corresponding to at least any one of the subfields, this adds a compensation value according to the pseudo pulses to the luminances of the subfields, thus reducing the luminance difference between the successive gray scale signals.

28 Claims, 4 Drawing Sheets

DEVICE FOR AND METHOD OF COMPENSATING IMAGE DISTORTION OF PLASMA DISPLAY PANEL

BACKGROUND OF THE INVENTION

1. Field of the Invention

The present invention relates to a color plasma display panel device and, more particularly, to a device for compensating for the image distortion of a plasma display panel by reducing the luminance difference between gray scale signals when the gray scales are realized with a subfield driving method.

2. Discussion of Related Art

According to the development and spread of data processing systems in the modern communications society, data display devices are of more importance and increasingly developed in their various types.

A CRT (Cathode Ray Tube) has been most widely used as a data display device, but it requires a large screen and large operating voltage. Also, when it displays straight lines, they appear curved. Because of these problems with the conventional CRTs, much research and development is being made on the flat display panel devices of all types having a matrix structure that will suit the purpose of recent tendencies to have a full-sized and flat screen.

The flat display panel devices have a flat matrix structure to display stable images thereon without any distortion or color blots. They are widely applicable such as full-sized televisions, wall-attached televisions and portable computers due to their thin shapes and low operating voltages.

The flat display panel device comprises various luminescent elements, i.e., PDP (Plasma Display Panel), ELD (Electroluminescent Display) and LED (Light Emitting Diode), or non-luminescent elements, i.e., LCD (Liquid Crystal Display), ECD (Electrochromic Display), DMD (Digital Mirror Device), AMD (Actuated Mirror Device) and GLV (Grating Light Valve).

A flat display panel device that comprises a PDP as one of the luminescent elements produces motion or still pictures by utilizing the gas discharge occurring in the PDP.

In the PDP as shown in FIG. 1, N first sustain electrode lines $X_1, X_2, \ldots, X_{N-1}, X_N$ and N second sustain electrode lines $Y_1, Y_2, \ldots, Y_{N-1}, Y_N$ are arranged in parallel at regular intervals, and M RGB address electrode lines $R_1, G_1, B_1, R_2, G_2, B_2, \ldots, R_{N-1}, G_{N-1}, B_{N-1}, R_N, G_N, B_N$ in parallel at regular intervals are deposited at right angles to the first and second sustain electrode lines $X_1 \sim X_N$, $Y_1 \sim Y_N$.

Discharge cells defined by respective intersections of the two lines on the screen have discharge gaps of the same size.

An image is displayed on the PDP when a gas discharge occurs selectively in each cell which is energized by the address and sustain electrodes arranged on the front and back glass plates. Forming one element of a matrix display can be realized by the production of plasma gas discharge and maintenance discharge between the address and sustain electrodes.

As a conventional method of driving the plasma display panel device, subfield driving methods are disclosed in Japanese Unexamined Patent Publication No. 4-195188, Japanese Patent Application No. 4-0340498, U.S. Pat. No. 5,436,634, and U.S. Pat. No. 5,446,344). In the subfield driving method, one frame is divided into x subfields to realize $2^x$ shades of gray. The relative ratio of the luminances of the subfields is 1:2:4:8:16:32:64: . . . . Thus the combination of several subfields forms a display whose elements correspond to the gray scales $0 \sim 2^x - 1$ in cells.

In FIGS. 2 and 3, a frame is divided into eight subfields SF1 to SF8. The ratio of the luminances of the subfields SF1 to SF8 is 1:2:4:16:32:64:128 to realize 256 shades of gray corresponding to the gray scales 0~255 (usually, represented by 8 bits, $D_7 \sim D_0$).

To drive the first subfield SF1, a gray scale signal of $D_0$ bit is applied to each cell so as to determine whether a discharge is carried out in the cell or not. If driving the second, third, fourth, fifth, sixth, seventh and eighth subfields SF2 to SF8, gray scale signals of $D_1, D_2, D_3, D_4, D_5, D_6$ and $D_7$ bits are applied to the cells, carrying out a discharge in a selected cell and maintaining it for a predetermined period of time to produce an image.

The plasma display device using the subfield driving method of the prior art is described as follows.

FIG. 4 is a schematic view showing the construction of the conventional plasma display device. Referring to FIG. 4, the plasma display device comprises: a PDP 1 having a plurality of address electrode lines, and first and second sustain electrode lines; RGB image signals that will be fed into the plurality of address electrode lines according to the signals externally supplied; first and second sustain pulses that will be fed into the first and second sustain electrodes; a control unit 2 for generating all kinds of control signals; first and second address drivers 3 and 3' for supplying the RGB image signals to the plurality of address electrode lines according to the control signal of the control unit 2; and first and second sustain drivers 4 and 5 for supplying the first and second sustain pulses to the plurality of first and second sustain electrodes according to the control signal.

As shown in FIG. 4, the first and second sustain pulses have the pulse difference of 180° with each other. When the first and second sustain pulses are applied to the first and second electrodes of the PDP 1, discharges are carried out between the first and second sustain electrodes at each rising edge of the respective pulses. Thus maintenance discharges occur between the address electrode and the first sustain electrode, to maintain the discharges.

The luminance of each gray scale signal is determined depending on the number of the first and second sustain pulses when realizing the gray scale by means of the subfield method to drive the plasma display device.

The process for producing a motion or still picture on the plasma display device according to the subfield driving method is described as follows.

Referring to FIG. 4, the control unit 2, and first and second sustain drivers 4 and 5 supply given pulses to the first and second sustain electrode lines $X_1 \sim X_N$, $Y_1 \sim Y_N$, thus erasing the discharges in all cells to prevent the respective cells from being affected by the prior discharges.

The first and second sustain drivers 4 and 5 supply scan pulses to the first and second sustain electrode lines $X_1 \sim X_N$, $Y_1 \sim Y_N$, and the first and second address drivers 3 and 3' supply a RGB image signal of one bit to the designated one of the address electrode lines $R_1$ to $R_N$. The fluorescent material coated on a designated cell that receives the 1-bit data (a high pulse) is excited to emit a light.

When the control unit 2, and first and second sustain drivers 4 and 5 supply the number of first and second sustain pulses corresponding to the first subfield SF1 to the first and second sustain electrode lines $X_1 \sim X_N$, $Y_1 \sim Y_N$, the luminescence in a designated cell is maintained for a period of time corresponding to the first subfield SF1.

The steps of erasing the discharges in all cells, supplying the RGB image signals, and supplying the first and second sustain pulses are repeated for the rest of the subfields SF2 to SF8, finally producing an image on the PDP 1.

When the gray scale is realized by the subfield driving method as described above, the luminance of the RGB image signals applied to each cell depends on the number of first and second sustain pulses applied to a plurality of the subfields constituting one frame. The color of one pixel is determined by the combination of the luminances of the RGB image signals.

Various colors are realized in one pixel by the combination of the red, blue and green visible lights of three RGB cells energized according to the RGB image signals (which are of the same bits as the number of the subfields) supplied to the address electrode lines $R_a$, $G_a$, $B_a$ of the RGB cells constituting one pixel for one frame.

Referring to FIG. 5, according to the subfield driving method as described above, various gray scale signals can be displayed by the combination of the subfields SF1, SF2, SF3, . . . each of which corresponds to the number of first and second sustain pulses proportional to the ratio of luminance (1:2:4:8:16:32:64:128: . . . ).

For example, after one frame is divided into eight subfields SF1 to SF8 to realize 256 ($=2^8$) shades of gray, the number of first and second sustain pulses that is proportional to the relative ratio of the luminances of the subfields SF1 to SF8 (1:2:4:16:32:64:128) are supplied to each subfield. With the combination of the eight subfields SF1 to SF8, the gray scale signals 0 to 255 can be displayed.

The process of displaying a gray scale signal, i.e., the gray scale signal 127 in one cell is described as follows. When driving the subfields SF1 to SF7, the pulse is supplied to the address electrode of a cell concerned so as to discharge the cell with the pulse supplied to the first sustain electrode and to maintain the discharge of the cell for a corresponding period of time. On driving the subfield SF8, the pulse is not supplied to the cell concerned, thus interrupting the discharge of the cell.

The cell supplied with the gray scale signal 127 is turned on seven times through the subfields SF1 to SF7, only to have the luminance proportional to the relative ratio of the luminance 1+2+4+8+16+32+64=127.

However, the quality of the image may be deteriorated such as an image distortion caused when adjacent gray scale signals are supplied in succession to one screen, for the luminance difference between the successive gray scale signals are too large due to the discharge mechanism by which the luminance varies right after the startup and just prior to the completion of the discharge.

For example, consider a gray scale signal 7 (1+2+4) that is realized with three times (or subfields) of discharge over a short period of time, relative to an adjacent gray scale signal 8 that is realized with one time (or subfields) of discharge over a long period of time. This results in a large luminance difference between the gray scale signals 7 and 8, and thus causes the image distortion when the two signals are successively supplied.

Further, the most severe image distortion may take place when the gray scale signal 256 is supplied with the gray scale signals 127 and 128 in succession on one screen.

SUMMARY OF THE INVENTION

Accordingly, the present invention is directed to a device for and a method of compensation the image distortion of a plasma display panel that substantially obviates one or more of the problems due to limitations and disadvantages of the related art.

An object of the present invention is to provide a device for and a method of compensating for the image distortion of a plasma display panel by adding a compensating value to the luminances of each subfield and thus reducing the luminance difference between the adjacent gray scale signals supplied to one screen in succession.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device for compensating for image distortion of a plasma display panel using a subfield driving method, comprises a control unit for generating the number of first and second sustain pulses that is proportional to the relative ratio of luminance of each subfield, and control signals, and an image distortion compensation unit for adding one or more first and second pseudo pulses in each interval of the first and second sustain pulses corresponding to at least any one of subfields, according to the control signals, and generating first and second compensation pulses to compensate for the image distortion.

The image distortion compensation unit comprises: first and second pulse delay units for delaying the first and second sustain pulses for times t1 and t2 (wherein t1 is longer than t2), respectively; a first pulse generator synchronized by the first sustain pulse delayed for the time t1, and producing at least one first pseudo pulse in each interval of the first sustain pulses corresponding to at least any one of the subfields; a second pulse generator synchronized by the second sustain pulse delayed for the time t2, and producing the same number of the second pseudo pulses having the same period as the first pseudo pulses; and first and second adders for adding the first and second pseudo pulses to the first and second sustain pulses, respectively, and generating the first and second compensation pulses.

In a plasma display device which includes a PDP for generating visible rays, an image distortion compensation unit for supplying compensation pulses to the PDP, and a control unit for supplying the compensation pulses and driving pulses to the PDP and image distortion compensation unit, respectively, the method of compensating for the image distortion of the plasma display device comprises the steps of: supplying the number of first and second sustain pulses that is proportional to the relative ratio of luminance of each subfield, and the driving pulse to the PDP, through the control unit and image distortion compensation unit; generating first and second compensation pulses having at least one of each of the first and second pseudo pulses in each interval of the first and second sustain pulses corresponding to at least any one of the subfields, according to the driving pulses; and compensating for the image distortion occurring in each cell through the number of discharges per unit time while the PDP discharges, according to the first and second compensation pulses.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 6:
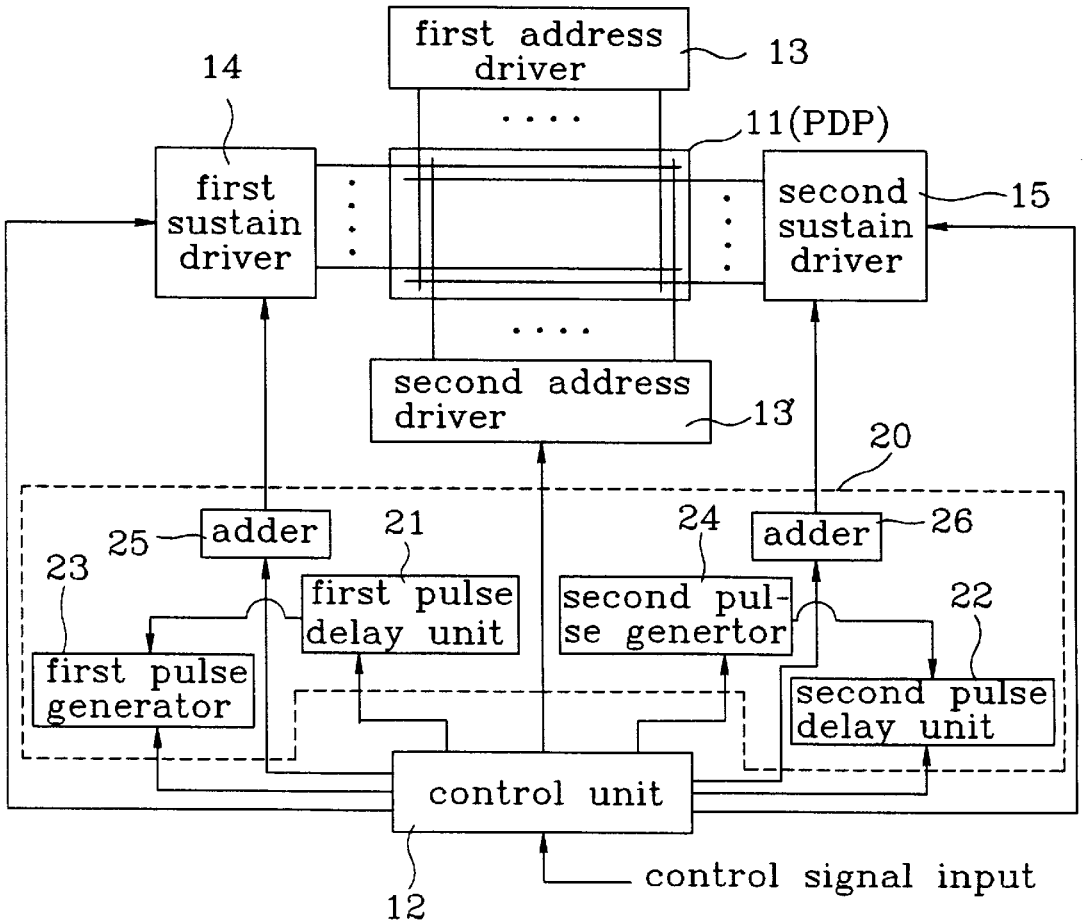
FIG. 6 is a block diagram showing the device for compensating for the image distortion of a plasma display panel according to the present invention and its driving circuit.

Referring to FIG. 6, a device for compensating for the image distortion of a plasma display device comprises: gray scale signals to be applied to the address electrode of a PDP 11; a control unit 12 for generating the number of first and second sustain pulses that is proportional to the relative ratio of the luminance of each subfield, and all kinds of control signals; address drivers 13 and 13' for supplying the gray scale signals to the address electrodes according to the control signals; first and second sustain drivers 14 and 15 for supplying first and second compensation pulses to the first and second sustain electrodes of the PDP 11, respectively so as to compensate for the image distortion according to the control signals; and an image distortion compensation unit 20 for adding at least one of each of the first and second pseudo pulses in each interval of the first and second sustain pulses corresponding to at least any one of the subfields designated according to the control signals, and transmitting the first and second compensation pulses to the first and second sustain drivers 14 and 15 so as to compensate for the image distortion.

The image distortion compensation unit 20 comprises: first and second pulse delay units 21 and 22 for delaying the first and second sustain pulses generated from the control unit 12 for times t1 and t2 (wherein t1>t2), respectively; a first pulse generator 23 synchronized by the first sustain pulse delayed for time t1, and producing at least one first pseudo pulse; a second pulse generator 24 synchronized by the second sustain pulse delayed for t2, and producing the same number of the second pseudo pulses having the same period as the first pseudo pulses; and first and second adders 25 and 26 for adding the first and second pseudo pulses to the first and second sustain pulses, respectively, and generating the first and second compensation pulses to the first and second sustain drivers 14 and 15.

The first and second pulse generators 23 and 24 are synchronized by the initial one of the first and second sustain pulses delayed for times t1 and t2, respectively, in each interval, thus generating at least one of each of the first and second pseudo pulses.

The first and second sustain pulses generated from the control unit 12 are identical to those as described in the prior art.

The preferred embodiments of the present invention may be described with reference to FIGS. 7 and 8.

The First Embodiment

Figure 7:
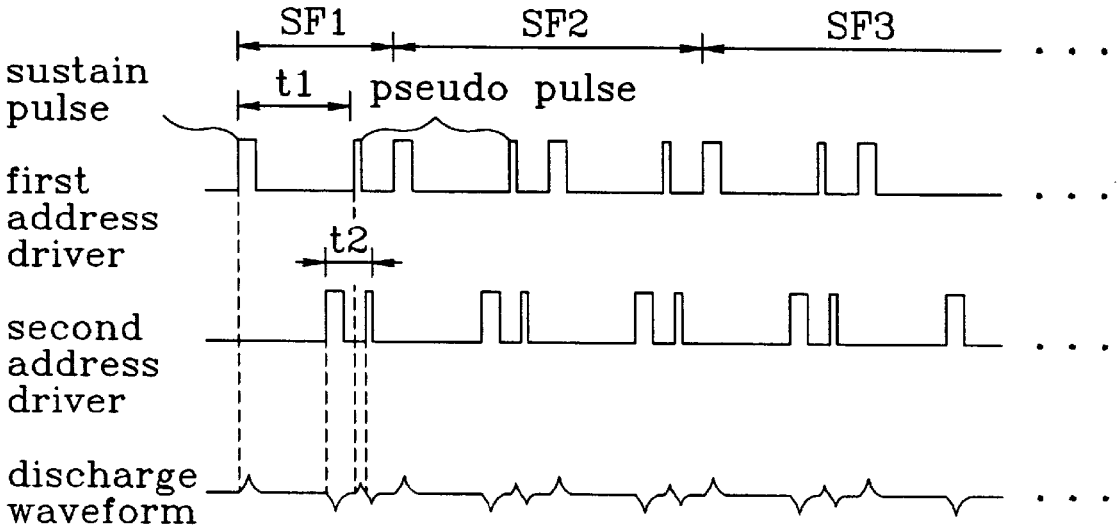
FIG. 7 is a timing diagram of voltage waveforms over the first and second sustain pulses applied according to a preferred embodiment of the present invention.

FIG. 7 is a timing diagram of the voltage waveforms over the waveforms of the first and second compensation pulses applied to compensate for the image distortion according to the first preferred embodiment.

Figure 1:
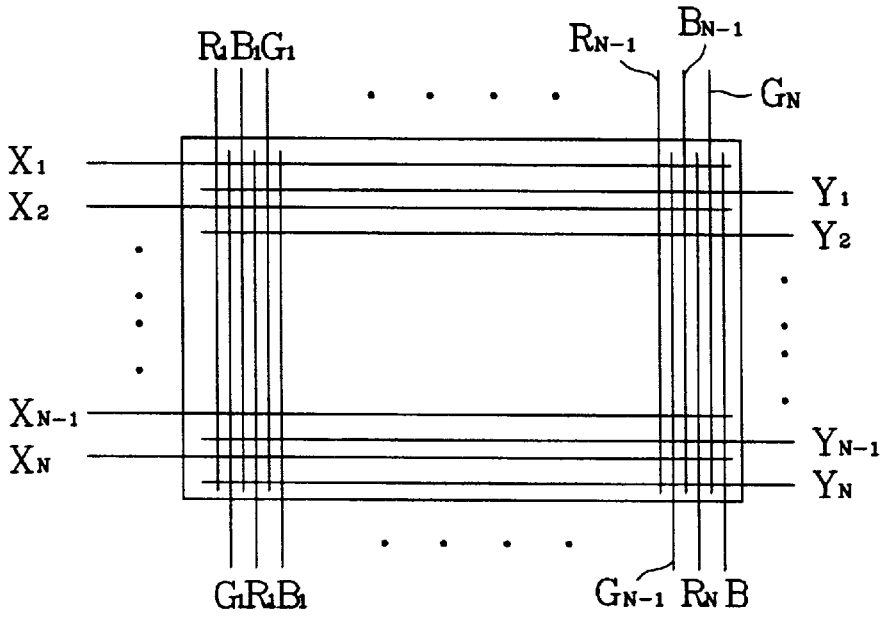
FIG.1 Prior Art
FIG. 1 shows the construction of the electrodes of a general plasma display panel.
Figure 2:
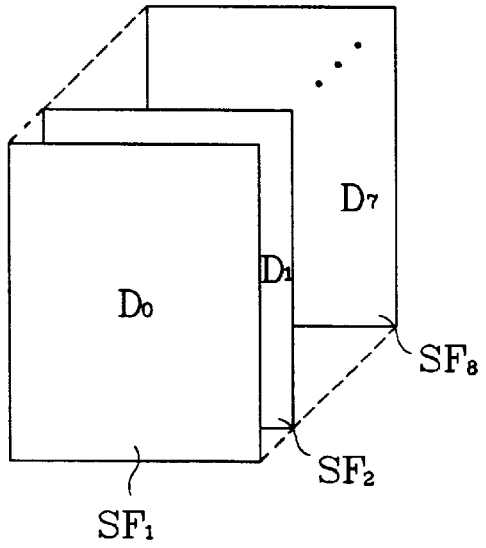
FIG.2 Prior Art
FIGS. 2 and 3 illustrates the concept of a subfield driving method of a plasma display panel to realize 256 shades of gray.
Figure 3:
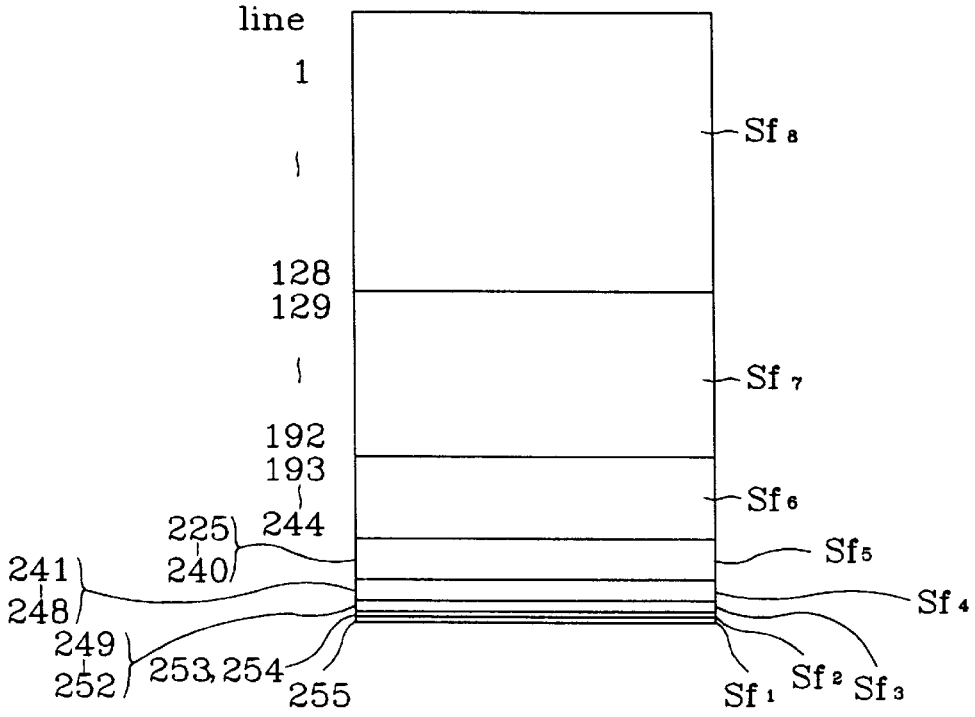
FIG.3 Prior Art
Figure 4:
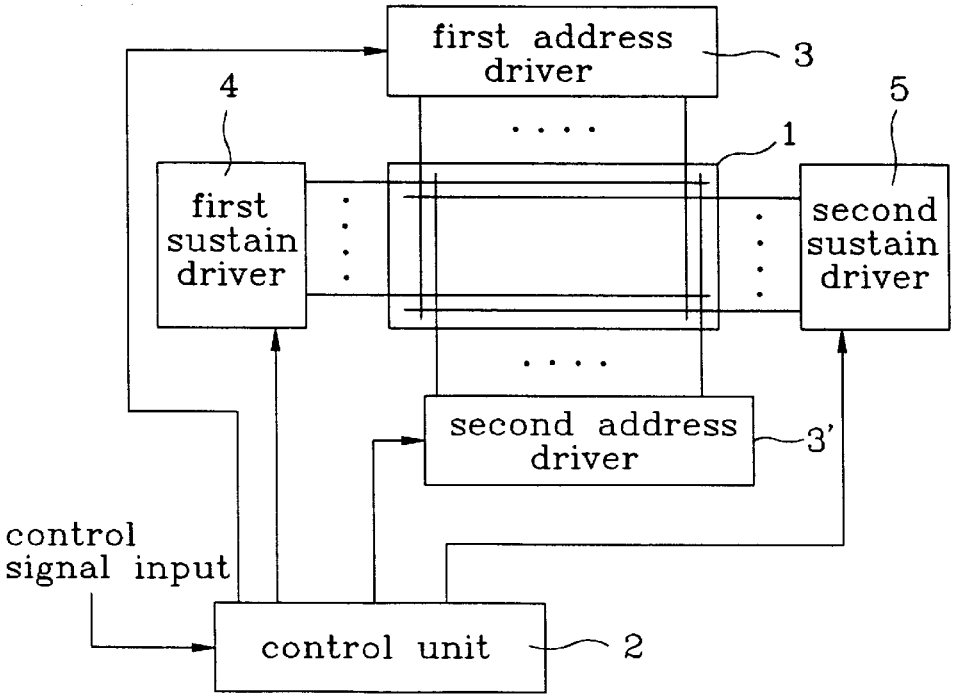
FIG.4 Prior Art
FIG. 4 is a schematic block diagram showing the construction of a plasma display panel according to a prior art.
Figure 5:
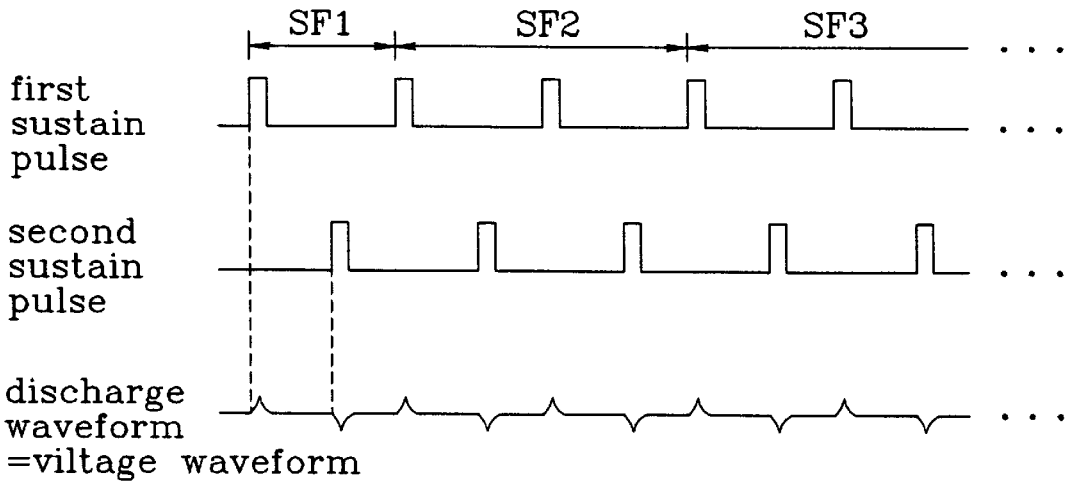
FIG.5 Prior Art
FIG. 5 is a timing diagram of voltage waveforms over the first and second sustain pulses applied according to the prior art.

The image distortion compensation unit 20 as shown in FIG. 5 adds one of each of the first and second pseudo pulses in each interval of the first and second sustain pulses corresponding to the subfields other than the last one having the largest relative ratio of luminance of a plurality of the subfields SF1, SF2, SF3 . . . , thus generating the first and second compensation pulses to the first and second sustain drivers 14 and 15, respectively.

For example, when 256 shades of gray are displayed, the image distortion compensation unit 20 transmits the first and second compensation pulses having one of each of the first and second pseudo pulses in each interval of the first and second sustain pulses corresponding to the subfields SF1 to SF7, to the first and second sustain drivers 14 and 15, respectively. The amount of discharges is increased since twice as many discharges are carried out in every one of the subfields SF1 to SF7 by the first and second pseudo pulses. As a result, the compensation value with the first and second pseudo pulses increases the luminance of each subfield SF1 to SF7 by one, thus accumulating the charges in the discharge cells.

When the luminances of the subfields SF1 to SF8 are 1, 2, 4, 8, 32, 64 and 128 according to the first and second sustain pulses, they are changed into $1+\alpha$, $2+\alpha$, $4+\alpha$, $8+\alpha$, $32+\alpha$, $64+\alpha$and $128+\alpha$ with the addition of the compensation value $\alpha$ by the first and second compensation pulses. The $\alpha$ is the compensation value according to the addition of the first and second pseudo pulses.

The resulting luminances of the adjacent gray scale signals, e.g., 31 and 32 are $31+5\alpha$ and $32+\alpha$, respectively. The luminance difference between them is $1-4\alpha=32+\alpha-(31-5\alpha)$.

Even when the luminance difference becomes largest, for example, $1-7\alpha$ for the adjacent gray scale signals 127 and 128 whose corresponding luminances are $127+7\alpha$ and 128, respectively, we can find that the luminance difference ($1-7\alpha=0.65$, when $\alpha$ is 0.55) is efficiently dropped compared with the prior art.

The Second Embodiment

Figure 8:
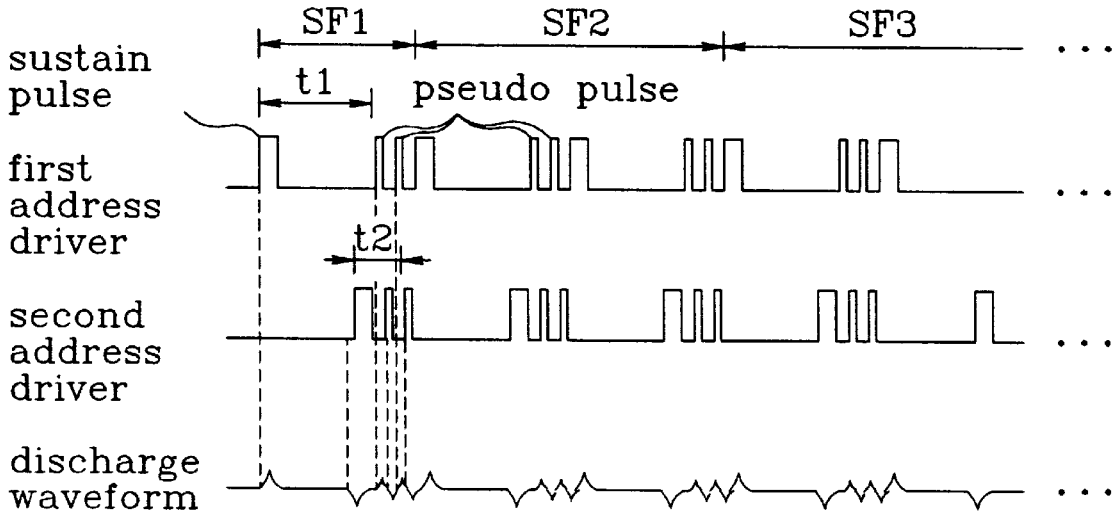
FIG. 8 is a timing diagram of voltage waveforms over the first and second sustain pulses applied according to another preferred embodiment of the present invention.

FIG. 8 is a timing diagram of voltage waveforms over the first and second sustain pulses applied according to the second preferred embodiment of the present invention.

The image distortion compensation unit 20 as shown in FIG. 5 adds two of each of the first and second pseudo pulses in each interval of the first and second sustain pulses corresponding to the subfields other than the last one having the largest relative ratio of luminance of a plurality of the subfields SF1, SF2, SF3 . . . , thus generating the first and second compensation pulses to the first and second sustain drivers 14 and 15, respectively.

For example, when 256 shades of gray are displayed, the image distortion compensation unit 20 transmits the first and second compensation pulses having two of each of the first and second pseudo pulses in each interval of the first and second sustain pulses corresponding to the subfields SF1 to SF7 to the first and second sustain drivers 14 and 15, respectively. The amount of discharges is increased since four times as many discharges are carried out in every one of the subfields SF1 to SF7 by the first and second pseudo pulses. As a result, the compensation value having two of each of the first and second pseudo pulses is added to the luminance of each subfield SF1 to SF7, thus accumulating the charges in the discharge cells.

When the luminances of the subfields SF1 to SF8 are 1, 2, 4, 8, 32, 64 and 128 according to the first and second sustain pulses, they are changed into $1+2\alpha$, $2+2\alpha$, $4+2\alpha$, $8+2\alpha$, $32+2\alpha$, $64+2\alpha$ and $128+2\alpha$ with the addition of the compensation value $2\alpha$ by the first and second compensation pulses.

The resulting luminances of the adjacent gray scale signals 31 and 32 are $31+10\alpha$ and $32+2\alpha$, respectively. The luminance difference between them is $1-8\alpha=32+2\alpha-(31+10\alpha)$. The luminance difference becomes largest, namely $1-14\alpha$, when the adjacent gray scale signals 127 and 128 are supplied in succession, while the corresponding luminances being $127+14\alpha$ and 128, respectively.

The luminance difference ($1-14\alpha=0.3$, when $\alpha$ is 0.05) is efficiently dropped compared with the first embodiment as well as with the prior art.

As shown in the first and second embodiments, the compensation of the image distortion can be more effective as the luminance difference between the gray scale signals is decreased due to the increment of the number of the first and second pseudo pulses added.

In another embodiment of the present invention, the compensation value according to the first and second pseudo pulses is added to all the subfields' luminances. The luminance difference can be also reduced in a similar manner but with less efficiency than the first and second embodiments.

In still another embodiment, the image distortion can be compensated by adding the random number of the first and second pseudo pulses in each interval of the first and second sustain pulses corresponding to at least any one of the subfields and thus adding different compensation values to the luminances of any subfields.

The present invention can enhance the quality of images even when adjacent gray scale signals are supplied in succession, by adding pseudo pulses in each interval of the sustain pulses corresponding to at least any one of the subfields. This adds a compensation value according to the pseudo pulses to the luminances of the subfields, As a result, this reduces luminance difference between the successive gray scale signals.

It will be apparent to those skilled in the art that various modifications and variations can be made in a device for and a method of compensating for the image distortion of a plasma display panel according to the present invention without departing from the spirit or scope of the invention. Thus, it is intended that the present invention cover the modifications and variations of this invention provided they come within the scope of the appended claims and their equivalents.

What is claimed is:

1. A device for compensating for image distortion of a plasma display panel (PDP) which realizes a gray scale by assembling a plurality of subfields having different relative ratios of luminance, the device comprising:

a control unit for generating the number of first and second sustain pulses which generate a sustain discharge that is proportional to the relative ratio of luminance of each subfield, and control signals; and an image distortion compensation unit for adding one or more first pseudo pulses and one or more second pseudo pulses in each interval of the first and second sustain pulses, respectively, corresponding to at least any one of subfields, according to the control signals, and for generating first and second compensation pulses to increase the magnitude of the sustain discharge so as to compensate for the image distortion.

2. The device as defined in claim 1, wherein the first and second compensation pulses are selectively added in each sustain period for at least two of the subfields.

3. The device as defined in claim 1, wherein the first and second compensation pulses are added in every sustain period.

4. The device as defined in claim 1, wherein the image distortion compensation unit comprises:

first and second pulse delay units for delaying the first and second sustain pulses by times t1 and t2 (wherein t1 is longer than t2), respectively;

a first pulse generator synchronized by the first sustain pulse delayed by the time t1, and producing at least one first pseudo pulse in each interval of the first sustain pulses corresponding to at least any one of the subfields;

a second pulse generator synchronized by the second sustain pulse delayed by the time t2, and producing the same number of the second pseudo pulses having the same period as the first pseudo pulses; and first and second adders for adding the first and second pseudo pulses to the first and second sustain pulses, respectively, and generating the first and second compensation pulses.

5. The device as defined in claim 1, wherein the image distortion compensation unit adds at least one of each of the first and second pseudo pulses in each interval of the first and second sustain pulses corresponding to the subfields other than one having the largest relative luminance ratio among the subfields.

6. The device as defined in claim 1, wherein the image distortion compensation unit adds the same number of the first and second pseudo pulses in each interval of the first and second sustain pulses.

7. The device as defined in claim 1, wherein the image distortion compensation unit adds a random number of the first and second pseudo pulses in each interval of the first and second sustain pulses, respectively.

8. A device for compensating for image distortion of a plasma display panel which uses a subfield driving method, comprising:

a PDP having a plurality of address electrodes, and first and second sustain electrodes;

a control unit for, according to an input signal externally supplied, generating gray scale signals to be applied to a plurality of the address electrodes, a plurality of first sustain pulses and a plurality of second sustain pulses which generate a sustain discharge in proportion to the relative ratio of luminance of each subfield to be applied to the first and second sustain electrodes, respectively, and control signals;

address drivers for supplying the gray scale signals to the address electrodes according to the control signals;

first and second sustain drivers for supplying first and second compensation pulses to compensate for the image distortion to the first and second sustain electrodes of the PDP, respectively, according to the control signals; and an image distortion compensation unit for adding at least one first pseudo pulse and at least one second pseudo pulse in each interval of the first and second sustain pulses, respectively, corresponding to at least any one of the subfields, according to the control signals, and for generating the first and second compensation pulses to increase the magnitude of the sustain discharge so as to compensate for the image distortion.

9. The device as defined in claim 8, wherein the first and second pseudo pulses are added in each sustain period for at least two of the subfields.

10. The device as defined in claim 8, wherein the first and second pseudo pulses are added in every sustain period.

11. The device as defined in claim 8, wherein the image distortion compensation unit comprises:

first and second pulse delay units for delaying the first and second sustain pulses by times t1 and t2 (wherein t1 is longer than t2), respectively;

a first pulse generator synchronized by the first sustain pulse delayed by the time t1, and producing at least one first pseudo pulse in each interval of the first sustain pulses corresponding to at least any one of the subfields;

a second pulse generator synchronized by the second sustain pulse delayed by the time t2, and producing the same number of the second pseudo pulses having the same period as the first pseudo pulses; and first and second adders for adding the first and second pseudo pulses to the first and second sustain pulses, respectively, and generating the first and second compensation pulses.

12. The device as defined in claim 8, wherein the image distortion compensation unit adds at least one of each of the first and second pseudo pulses in each interval of the first and second sustain pulses corresponding to the subfields other than one having the largest relative luminance ratio among the subfields.

13. The device as defined in claim 8, wherein the image distortion compensation unit adds the same number of the first and second pseudo pulses in each interval of the first and second sustain pulses.

14. The device as defined in claim 8, wherein the image distortion compensation unit adds a random number of the first and second pseudo pulses in each interval of the first and second sustain pulses, respectively.

15. A method of compensating for image distortion of a plasma display device which includes a PDP for generating visible rays, an image distortion compensation unit for supplying compensation pulses to the PDP, and a control unit for supplying the compensation pulses and driving pulses to the PDP and image distortion compensation unit, respectively, the method comprising the steps of:

supplying the number of first and second sustain pulses that is proportional to the relative ratio of luminance of each subfield, and the driving pulse to the PDP, through the control unit and image distortion compensation unit;

generating first and second compensation pulses having at least one first pseudo pulse and at least one second pseudo pulse in each interval of the first and second sustain pulses corresponding to at least any one of the subfields, according to the driving pulses; and compensating for the image distortion occurring in each cell through the number of discharges per unit time while the PDP discharges, according to the first and second compensation pulses.

16. The method as defined in claim 15, wherein the first and second pseudo pulses are added in each sustain period for at least two of the subfields.

17. The method as defined in claim 15, wherein the first and second pseudo pulses are added in every sustain period.

18. The method as defined in claim 15, wherein compensating for the image distortion comprises the steps of:

delaying the first and second sustain pulses by times t1 and t2 (wherein t1 is longer than t2), respectively;

generating at least one first pseudo pulse in each interval of the first sustain pulses corresponding to at least any one of the subfields in synchronization with the first sustain pulse delayed by the time t1;

generating the same number of the second pseudo pulses having the same periods as the first pseudo pulses in synchronization with the first sustain pulse delayed by the time t1; and adding the first and second pseudo pulses to the first and second sustain pulses to generate the first and second compensation pulses.

19. The method as defined in claim 15, wherein the image distortion is compensated by adding at least one of each of the first and second pseudo pulses in each interval of the first and second sustain pulses corresponding to the subfields other than one having the largest relative luminance ratio among the subfields.

20. The method as defined in claim 15, wherein the image distortion is compensated by adding the same number of the first and second pseudo pulses in each interval of the first and second sustain pulses.

21. The method as defined in claim 15, wherein the image distortion is compensated a adding the random number of the first and second pseudo pulses in each interval of the first and second sustain pulses, respectively.

22. A method of compensating for image distortion of a plasma display device which includes a PDP having a plurality of address electrodes and first and second sustain electrodes, an image distortion compensation unit for supplying compensation pulses to the PDP, and a control unit for supplying the compensation pulses and driving pulses to the PDP and image distortion compensation unit, respectively, the method comprising:

generating gray scale signals to be supplied to a plurality of the address electrodes through the control unit, a number of discharge sustain pulses to be supplied to the first and second sustain electrodes, and control signals, the number of discharge sustain pulses being proportional to the relative ratio of luminance of each subfield;

supplying gray scale signals to a plurality of the address electrodes and compensation pulses to the first and second sustain electrodes of the PDP, through the control signals; and adding at least one first pseudo pulse and at least one second pseudo pulse in each interval to the sustain pulses corresponding to at least any one of the subfields according to the control signals, to produce the plurality of the compensation pulses thereby compensating for image distortion occurring during the discharge of the PDP.

23. The method as defined in claim 22, wherein the first and second pseudo pulses are added in each sustain period for at least two of the subfields.

24. The method as defined in claim 22, wherein the first and second pseudo pulses are added in every sustain period.

25. The method as defined in claim 22, wherein compensating for the image distortion comprises the steps of:

delaying the first and second sustain pulses by times t1 and t2 (wherein t1 is longer than t2), respectively;

generating at least one first pseudo pulse in each interval of the first sustain pulses corresponding to at least any one of the subfields in synchronization with the first sustain pulse delayed by the time t1;

generating the same number of the second pseudo pulses having the same periods as the first pseudo pulses in synchronization with the first sustain pulse delayed by the time t1; and adding the first and second pseudo pulses to the first and second sustain pulses to generate the first and second compensation pulses.

26. The method as defined in claim 22, wherein the image distortion is compensated by adding at least one of each of the first and second pseudo pulses in each interval of the first and second sustain pulses corresponding to the subfields other than one having the largest relative luminance ratio among the subfields.

27. The method as defined in claim 22, wherein the image distortion is compensated by adding the same number of the first and second pseudo pulses in each interval of the first and second sustain pulses.

28. The method as defined in claim 22, wherein the image distortion is compensated by adding the random number of the first and second pseudo pulses in each interval of the first and second sustain pulses, respectively.

* * * * *